US008950194B2

(12) United States Patent
Hughes et al.

(10) Patent No.: US 8,950,194 B2
(45) Date of Patent: Feb. 10, 2015

(54) REDUCTION OF CRYOGEN LOSS DURING TRANSPORTATION

(75) Inventors: Timothy John Hughes, New Milton Hampshire (GB); Stephen Paul Trowell, Finstock Oxfordshire (GB); Keith White, Abingdon Oxfordshire (GB)

(73) Assignee: Siemens PLC, Frimley, Camberley, Surrey (GB)

( * ) Notice: Subject to any disclaimer, the term of this patent is extended or adjusted under 35 U.S.C. 154(b) by 2071 days.

(21) Appl. No.: 11/597,654

(22) PCT Filed: May 12, 2005

(86) PCT No.: PCT/EP2005/005152

§ 371 (c)(1),
(2), (4) Date: Sep. 11, 2007

(87) PCT Pub. No.: WO2005/116514

PCT Pub. Date: Dec. 8, 2005

(65) Prior Publication Data

US 2008/0155995 A1 Jul. 3, 2008

(30) Foreign Application Priority Data

May 25, 2004 (GB) ..... 0411605.9
Oct. 25, 2004 (GB) ..... 0423637.8

(51) Int. Cl.
*F17C 3/10* (2006.01)
*F25B 19/00* (2006.01)
(Continued)

(52) U.S. Cl.
CPC ..... *F25B 19/005* (2013.01); *F25D 19/006* (2013.01); *F17C 2270/0527* (2013.01); *H01F 6/04* (2013.01); *H01F 27/002* (2013.01)
USPC ..... 62/48.3; 62/48.2; 62/51.1; 335/216

(58) Field of Classification Search
CPC ..... F25B 19/005; F17C 2223/0161
USPC ..... 62/48.2, 48.3, 51.1; 335/216
See application file for complete search history.

(56) References Cited

U.S. PATENT DOCUMENTS 2,834,187 A * 5/1958 Loveday ..... 62/48.3
4,279,127 A * 7/1981 Longsworth ..... 62/77
(Continued)

FOREIGN PATENT DOCUMENTS

EP 0 726 582 A1 8/1996
GB 955320 4/1964
(Continued)

OTHER PUBLICATIONS

German Search Report dated May 26, 2005 (One (1) page).
(Continued)

*Primary Examiner* — Allen Flanigan
*Assistant Examiner* — Filip Zec
(74) *Attorney, Agent, or Firm* — Crowell & Moring LLP

(57) ABSTRACT

In order to minimize the loss of cryogen during transportation of superconductive magnet systems, or indeed at any time that the refrigerator is turned off, part of the boil-off gas is directed from the cryogen vessel through the refrigerator interface and past the refrigerator to cool the refrigerator. Some of the heat conducted along the refrigerator into the system is intercepted and removed by that part of the boil-off gas. The heat load onto the cryogenic vessel is thereby reduced, which in turn reduces the boil-off of cryogen from the cryogenic vessel. This part of the boil-off gas is then vented from the system along with the remainder of the boil-off gas, for example to leave the cryogenic liquid vessel via the access neck.

19 Claims, 5 Drawing Sheets

(51) Int. Cl.

| | |
|---|---|
| ***H01F 1/00*** | (2006.01) |
| ***F25D 19/00*** | (2006.01) |
| *H01F 6/04* | (2006.01) |
| *H01F 27/00* | (2006.01) |

(56) References Cited

U.S. PATENT DOCUMENTS

| | | | | |
|---|---|---|---|---|
| 5,235,818 | A | 8/1993 | Horikawa et al. | |
| 5,265,430 | A | 11/1993 | Chen et al. | |
| 5,339,650 | A * | 8/1994 | Hakamada et al. | 62/51.1 |
| 5,381,666 | A | 1/1995 | Saho et al. | |
| 5,583,472 | A * | 12/1996 | Moritsu et al. | 335/216 |
| 5,586,437 | A | 12/1996 | Blecher et al. | |
| 5,956,957 | A | 9/1999 | Lowry et al. | |
| 6,389,821 | B2 * | 5/2002 | Strobel et al. | 62/47.1 |
| 6,807,812 | B2 * | 10/2004 | Lehmann et al. | 62/47.1 |
| 6,990,818 | B2 | 1/2006 | Hofmann | |

FOREIGN PATENT DOCUMENTS

| | | |
|---|---|---|
| GB | 1077145 | 7/1967 |
| JP | 60-104898 A | 6/1985 |
| JP | 60-234385 A | 11/1985 |
| WO | WO 01/94839 A1 | 12/2001 |

OTHER PUBLICATIONS

International Search Report dated Aug. 10, 2005 (Two (2) pages).

* cited by examiner

REDUCTION OF CRYOGEN LOSS DURING TRANSPORTATION

Superconducting magnet systems are used for medical diagnosis, for example in magnetic resonance imaging systems. A requirement of an MRI magnet is that it produces a stable, homogeneous, magnetic field. In order to achieve the required stability, it is common to use a superconducting magnet system which operates at very low temperature. The temperature is typically maintained by cooling the superconductor by immersion in a low temperature cryogenic fluid such as liquid helium.

The superconducting magnet system typically comprises a set of superconductive windings for producing a magnetic field, in a cryogenic fluid vessel which contains the superconductor windings, immersed in a cryogenic fluid to keep the windings at a superconducting temperature. The cryogenic fluid vessel is typically surrounded by one or more thermal shields, and a vacuum jacket completely enclosing the shield (s) and the cryogenic vessel.

An access neck typically passes through the vacuum jacket from the exterior, into the cryogenic vessel. Such access neck is used for filling the cryogenic vessel with cryogenic liquids and for passing services into the cryogenic vessel to ensure correct operation of the magnet system.

Cryogenic fluids, and particularly helium, are expensive and it is desirable that the magnet system should be designed and operated in a manner to reduce to a minimum the amount of cryogenic liquid consumed. Cryogenic liquid may be lost due to boil-off, caused by thermal leaks into the cryogenic vessel. The vacuum jacket reduces the amount of heat leaking to the cryogenic vessel by conduction and convection. The thermal shields reduce the amount of heat leaking to the cryogenic vessel by radiation. In order to further reduce the heat load—the heat leaking to the cryogenic fluid vessel, and thus the loss of liquid—it is common practice to use a refrigerator to cool the thermal shields to a low temperature. It is also known to use such a refrigerator to directly refrigerate the cryogen vessel, thereby reducing the cryogen fluid consumption. It is also known to use a two-stage refrigerator, in which a first stage is used to cool the thermal shield(s), and the second stage is used to cool the cryogenic vessel.

It is desirable that such superconducting magnet systems should be transported from the manufacturing site to the operationals site containing the cryogen liquid, so that they can be made operational as quickly as possible. During transportation, the refrigerator cooling the one or more shields and/or the cryogen vessel is inactive, and is incapable of diverting the heat load from the cryogen vessel. Indeed, the refrigerator itself provides a low thermal resistance path for ambient heat to reach the cryogenic vessel. This in turn means a relatively high level of boil-off during transportation, leading to loss of cryogen liquid. The boiled off cryogen is typically vented to the atmosphere in such circumstances. It is desirable to reduce the loss of cryogen to the minimum possible, both since cryogens are costly and in order to prolong the time available for delivery: the time during which the system can remain with the refrigerator inoperable but still contain some cryogen liquid.

In prior configurations, the gas boiled off from the cryogen liquid leaves the cryogen vessel solely through the access neck. It is well known that the cold gas from boiling cryogenic liquids can be employed to reduce heat input to cryogen vessels, by using the cooling power of the gas to cool the access neck of the cryogen vessel and to provide cooling to thermal shields by heat exchange with the cold exhausting gas.

When the refrigerator of the superconductive magnet system is turned off for transportation, ambient heat is conducted along the passive refrigerator to reach the thermal shield(s) and/or the cryogen vessel. The refrigerator is typically removably connected to the thermal shield(s) and cryogenic vessel by a refrigerator interface. It has been demonstrated that removing the refrigerator from the refrigerator interface can noticeably reduce the heat load onto the internal parts of the system, and therefore reduce the loss of cryogenic liquid. However, the benefits of this solution are outweighed by its disadvantages the refrigerator must be replaced when putting the MRI system into operation, and it is desired to keep this latter operation as simple as possible. Replacing the refrigerator may involve difficult and skilled operations. It is also required to permit operation of the refrigerator as soon as possible after the magnet system arrives at site, and even before the system has been fully set up, to prevent further loss of cryogen.

The present invention accordingly addresses the problem of cryogen loss from an inoperative superconductive magnet system, in particular the problem that the inoperative refrigerator presents a heat load on the magnet system which results in loss of cryogenic liquid.

The present invention therefore provides methods and apparatus as defined in the appended claims.

According to an aspect of the present invention, in order to minimize the loss of cryogen during transportation of superconductive magnet systems, or indeed at any time that the refrigerator is turned off, part of the boil-off gas is directed from the cryogen vessel through the refrigerator interface and past the refrigerator to cool the refrigerator. Some of the heat conducted along the refrigerator into the system is intercepted and removed by that part of the boil-off gas. The heat load onto the cryogenic vessel is thereby reduced, which in turn reduces the boil-off of cryogen from the cryogenic vessel. This part of the boil-off gas is then vented from the system along with the remainder of the boil-off gas, for example to leave the cryogenic liquid vessel via the access neck.

The above, and further, objects, characteristics and advantages of the present invention will be described with reference to a number of specific embodiments, given by way of examples only, in conjunction with the accompanying drawings, wherein.

Figure 1:
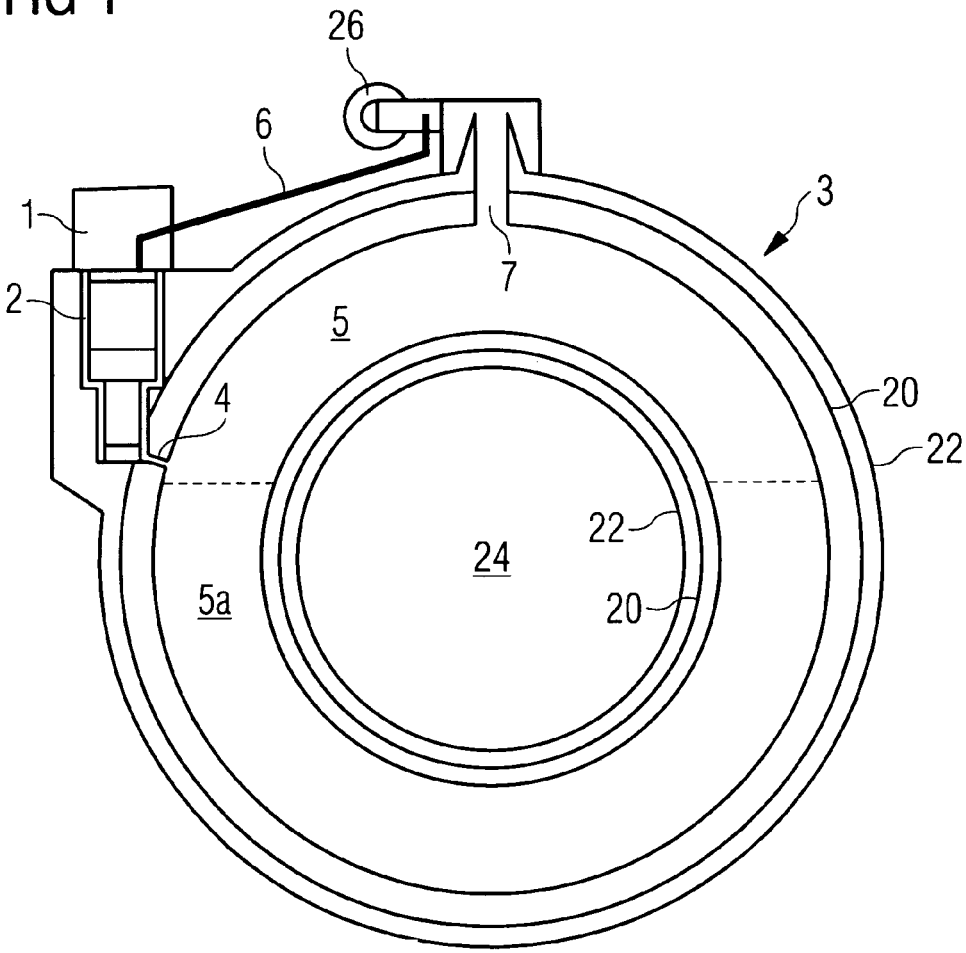
FIG. 1 shows a cross-section of a superconducting magnet system for use in an MRI system, adapted according to an embodiment of the present invention.

FIG. 1 shows a cross-section of a superconducting magnet system 3 for use in an MRI system, adapted according to an embodiment of the present invention. A two-stage cryogenic refrigerator 1 is removably connected by an interface sock (also known as an interface sleeve) 2, such that its first stage cools the shield 20 and its second stage cools the cryogenic vessel 5. The refrigerator is preferably arranged as a recondensing refrigerator. A heat exchanger cooled by the second stage of the refrigerator is exposed to the interior of the cryogenic vessel 5, for example by a tube 4. The refrigerator is, in operation, thereby enabled to reduce the consumption of cryogenic liquid by recondensation of boiled off cryogen back into its liquid state.

Superconductive magnet coils (not shown) are provided in cryogenic vessel 5. The interface sock is a chamber extending from the exterior of the cryostat 3 to be in thermal connection with the cryogen vessel 5. In some embodiments, the interior of the cryogen, vessel may, be exposed to the interior of the sock. The sock is preferably composed of a thin wall of a material of relatively low thermal conductivity, such as certain grades of stainless steel. The coils are immersed in a cryogenic liquid 5*a*. A thermal, shield 20 is provided around the cryogenic vessel. A vacuum jacket 22 encloses the cryogenic vessel and the shield in a vacuum. A central bore 24 is provided, to accommodate a patient for examination. An access neck 7 is provided to allow access to the cryogenic vessel 5.

According to an embodiment of the present invention, a pipe 6 provides a gas conduit from the top of the interface sock 2 to the top of the access neck 7. Boil-off gas from the cryogen 5*a* may flow from the cryogen vessel 5 through tube 4, through interface sock 2 and along pipe 6 to the access neck 7.

The advantage provided by the presence of the pipe 6 is that, during transportation, a proportion of the boil-off gas from the boiling cryogen passes up through the interface sock 2, past the refrigerator 1. This cools the refrigerator 1 and reduces the ambient heat being conducted into the superconductive magnet system by the inoperative refrigerator 1. Preferably, the pipe 6 is closed by one or more valves when the superconductive magnet system is in operation.

Figure 2:
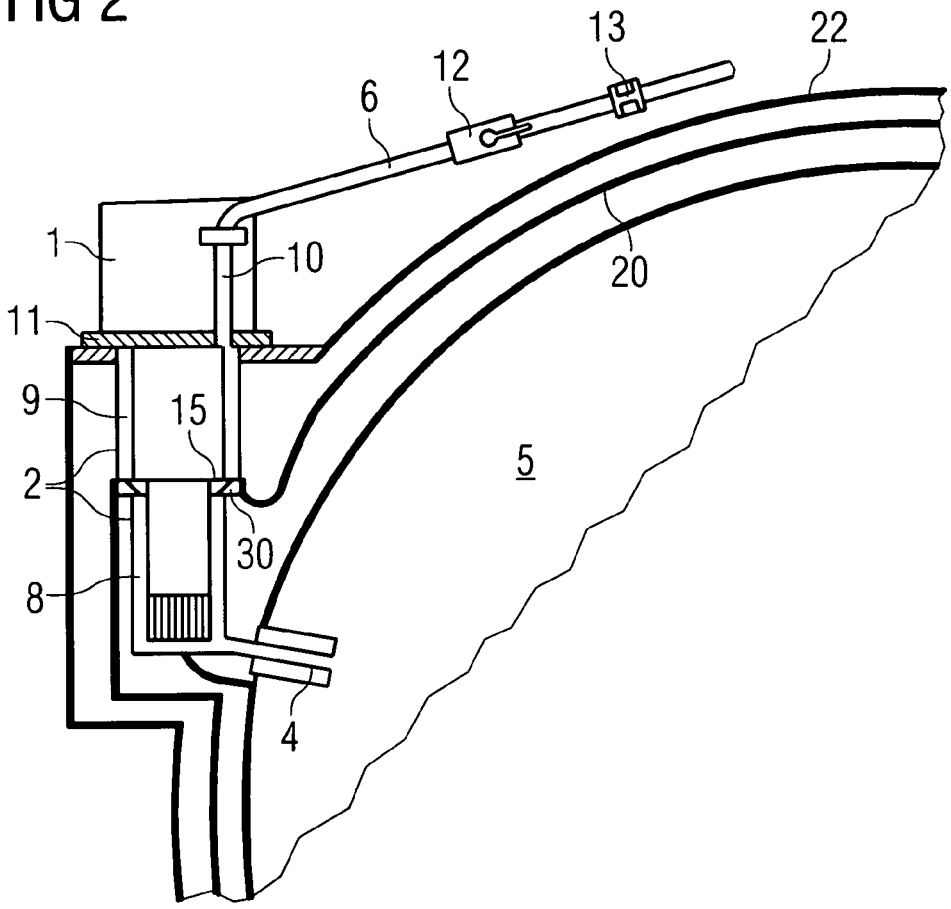
FIG. 2 shows a cross section of part of the superconducting magnet system of FIG. 1 in more detail.

FIG. 2 shows a more detailed view of the refrigerator interface sock 2 and the pipe 6. During transportation, and indeed during any time when the refrigerator 1 is inoperative, boil-off of the cryogen 5*a* will occur, and boil-off gas will be produced at a temperature slightly above the boiling point of the cryogen. Liquid helium is currently used in many superconductive magnet systems. In such a system, the boil-off gas will have a temperature in the range of 4K. The refrigerator will be exposed to an ambient temperature of approximately 300K. Since the refrigerator 1 is inoperative, a temperature gradient will be established along the length of the refrigerator. The present invention essentially aims to adjust the profile of that temperature gradient.

Boil-off gases generated in cryogenic vessel 5 may leave the vessel either by the access neck 7, or, according to an aspect of the present invention, through the tube 4, through the interface sock 2, past the refrigerator, and then through pipe 6. These two paths preferably meet just upstream of an exhaust valve 26 (FIG. 1). The boil-off gas flowing past the refrigerator first passes into the space 8 between the refrigerator second stage and a lower section of the interface sock, thence into the space 9 between the refrigerator first stage and an upper section of the interface sock. In order to travel between the lower and upper sections of the interface sock, the gas must traverse the thermal connection 15, 30 which thermally links the refrigerator first stage to the thermal shield 20. This is described further below, with reference to FIG. 3. The boil-off gas then flows into connecting pipe 10 which is attached to top flange 11 of the refrigerator, and thence into the pipe 6.

Pipe 6 is preferably fitted with a valve 12 which is open during transportation but may be closed during normal operation of the magnet system when the refrigerator is operational. In addition, pipe 6 may be fitted with a means 13 to regulate the flow of gas past the refrigerator, conveniently realized by use of a suitably sized orifice. The orifice may be of fixed size, or may be adjustable.

Figure 3:
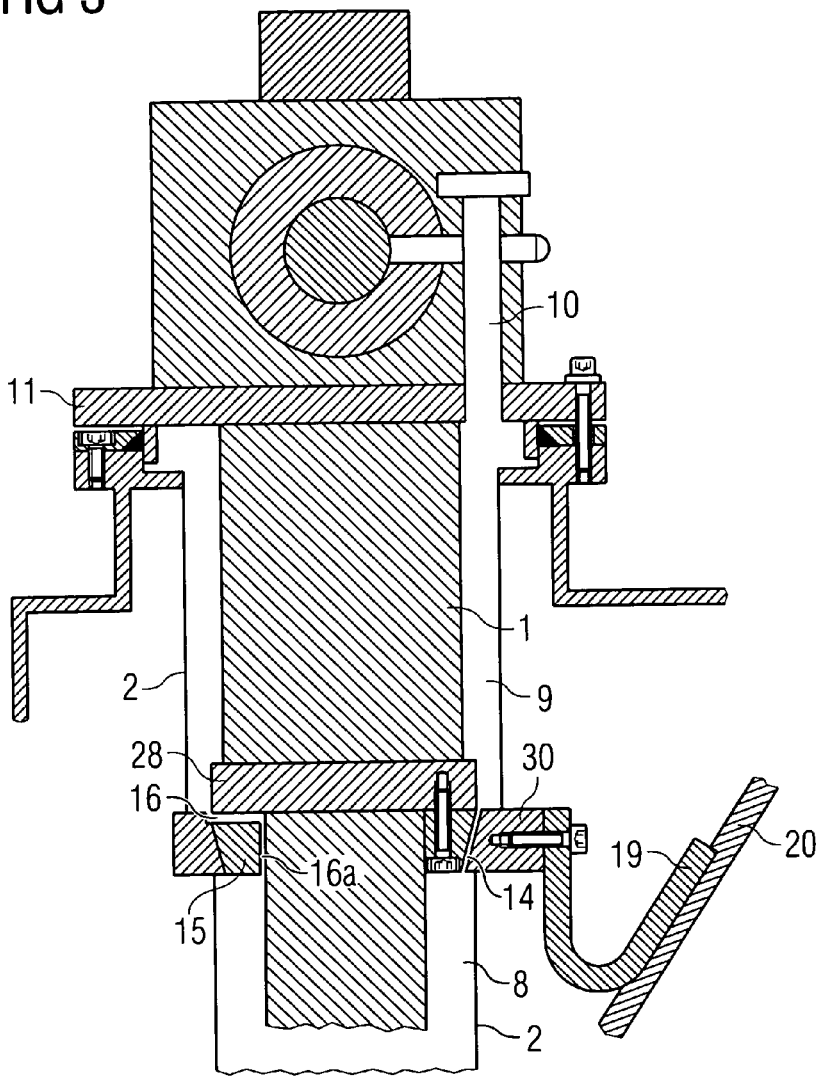
FIG. 3 shows certain details of the embodiment of the invention shown in FIG. 2.
Figure 3:
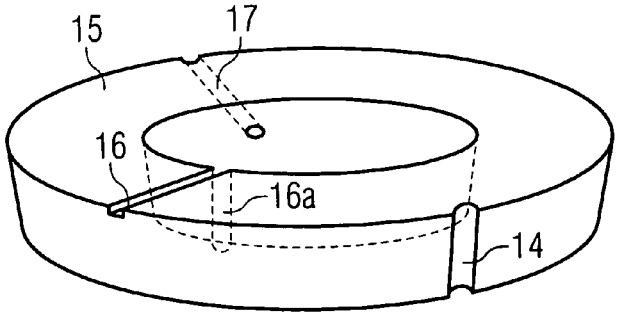

FIG. 3 shows further detail of the refrigerator in the interface sock and in particular the thermal connection 15, 30 of the first stage of the refrigerator to the shield 20. In this example, thermal connection between the first stage heat exchanger 28 and its contact flange 15, and the thermal contact 30 linked to shield 20 is achieved by using a pressed taper, although other means known in the art may alternatively be employed. The thermal connection may employ indium metal to improve the thermal contact between contact flange 15 and thermal contact 30.

As mentioned above, the boil-off gas which flows through lower part 8 of sock 2, past, the refrigerator's second stage must traverse the thermal connection 15, 30 which thermally links the refrigerator first stage to the thermal shield 20. FIG. 3 illustrates certain alternative arrangements providing a path for the boil-off gas through the thermal connection.

The boil-off gas may pass through the thermal connection via channels providing a passageway past or through the contact flange 15. In one embodiment illustrated in FIG. 3, a channel 14 is cut into an outer contact face of the contact flange. In another embodiment, a channel 16*a* is cut into an inner face of the contact flange with a connected radial channel 16 cut into the upper surface of the contact flange. On the main drawing of FIG. 3, the channel 14 is shown in position in the right hand side, with the channels 16, 16*a* in position being shown on the left hand side. In a further alternative embodiment, an oblique hole 17 may be drilled or otherwise formed through the contact flange 15, to provide a passageway for gas to flow between lower sock portion 8 and upper sock portion 9. While the alternatives 14; 16, 16*a* are simpler to manufacture, they have the disadvantage that the area of contact between the refrigerator first stage heat exchanger and the contact flange, respectively between the contact flange and the thermal contact 30, is reduced. Oblique hole 17 does not have this disadvantage, but may be more difficult to manufacture. With any of these embodiments, the boil-off gas passing through-or past the contact flange 15 is in good thermal contact with the flange and therefore with the thermal contact 30, and assists in cooling the thermal shield 20 which is thermally connected to the first cooling stage of the refrigerator by thermal like 19, which may be of any suitable known type, such as flexible copper braiding.

In alternative embodiments, passageways such as those shown at 14, 16, 16*a*, 17 may alternatively, or additionally, be provided in the thermal contact 30 rather than only in the contact flange 15.

As the boil-off gas flows past the refrigerator, initially at a temperature of about 4K, the refrigerator is cooled. The heat removed by the boil-off gas heats the gas as it passes upwards through the sock. Although the boil-off gas has been heated, it remains at a very low temperature. The boil-off gas will accordingly be very effective to cool the refrigerator along its entire length, and to cool the shield 20 by cooling the thermal interface 30 during its passage through or past the contact flange 15 and/or the thermal interface 30.

Figure 5:
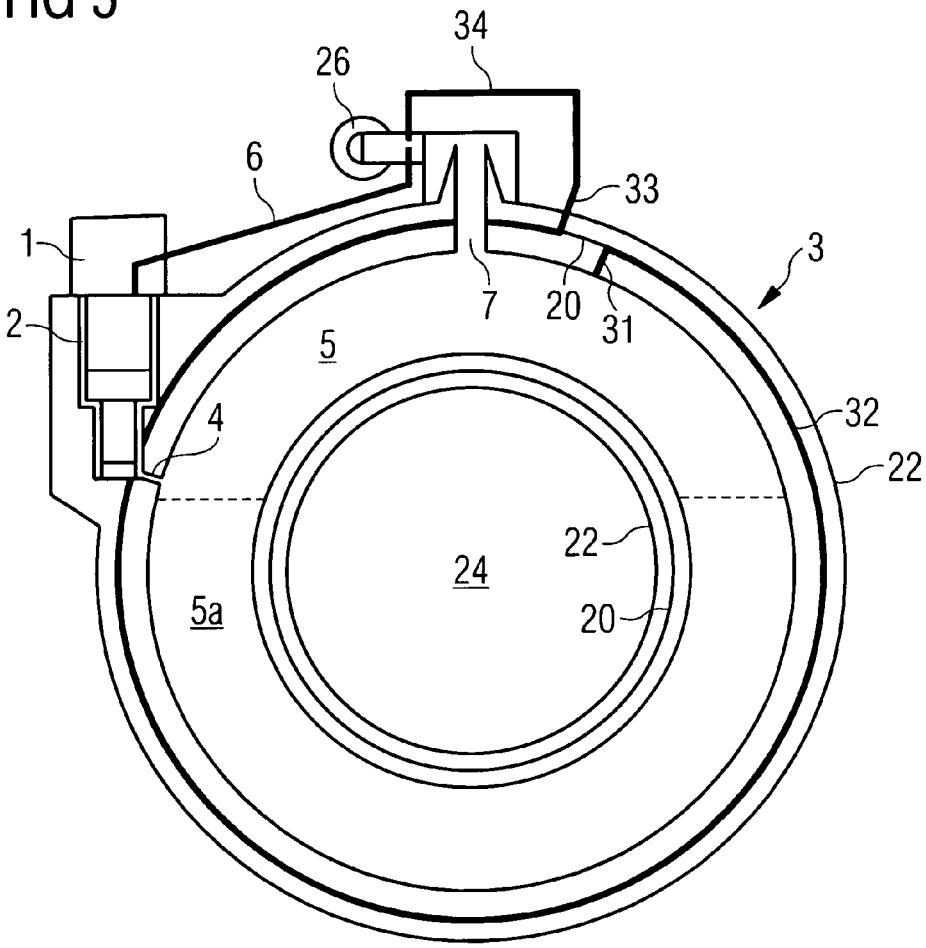
FIG. 5 shows an embodiment of the present invention adapted for shield cooling.

In addition to cooling of the shield 20 via the thermal link 19, and as illustrated in FIG. 5, cryogen boil-off gas may be used to cool the shield 20 directly; in much the same way as it is used to cool the refrigerator. Cold gas may be taken from helium vessel 5 via pipe 31, which is preferably of low thermal conductivity, and passed through a tube 32 which is in close thermal contact with the shield. One embodiment of this principle is shown in FIG. 5. The tube would exit from the vacuum jacket 22 via pipe 33, which is preferably of low thermal conductivity, into the venting system via pipe 34. Gas flow may be controlled by use of valves and orifices, in the same manner as described below for refrigerator cooling. By this means, the gas flow may be balanced to optimize the cooling performance for the system.

This configuration maximises the use of the gas enthalpy to cool the shield, and may be used to minimize the cryogen losses during transport of the system. Liquid cryogens may also be passed through this heat exchanger tube to reduce the time required for initial cool-down of the system from room temperature.

Refrigerator 1 may be of any known type, such as a Gifford-McMahon or pulse tube refrigerator. The upper parts of the refrigerator, in particular, may contain relatively delicate mechanical parts. There is a risk that the flow of boil-off gas past the refrigerator, as provided by the present invention, may damage certain parts of the refrigerator by cooling them to a temperature far below their normal operating temperature. In certain embodiments of the present invention, therefore, steps must be taken to ensure that the refrigerator is not excessively cooled by the boil-off gas to such an extent that damage to the refrigerator may be caused.

According to an aspect of the present invention, a restrictor orifice 13 may be placed on the pipe 6. This may be a fixed orifice or an adjustable orifice. By limiting the rate of gas flow in the tube 6, the mass flow of boil-off gas past the refrigerator may be controlled, and so the refrigerating effect of the boil-off gas on the various parts of the refrigerator may be controlled. The passageway such as 14; 16, 16*a*; 17 through the thermal connection 15, 30 also acts as a gas flow rate regulation. By suitably controlling the dimensions of the channel through the thermal connection and the orifice 13, the cooling of the different parts of the refrigerator 1 by escaping boil-off gas may be controlled. The orifice 13 may also be suitably sized to limit the gas flow through pipe 6 to balance the flow through pipe 6 with the flow of boil-off gas through the access neck 7. For this latter purpose, the gas flow in tube 6 and in the access neck 7 may be measured, to ensure appropriate, cooling of the refrigerator. The gas flows may also be measured for other purposes, such as for monitoring the amount of cryogen remaining in the cryogen vessel.

The presence of orifice 13 has also been found beneficial in preventing a convection flow of boil-off gas, which might otherwise flow in a path through sock 2, pipe 10 and access neck 7 back into the cryogenic vessel, or vice versa.

Figure 4:
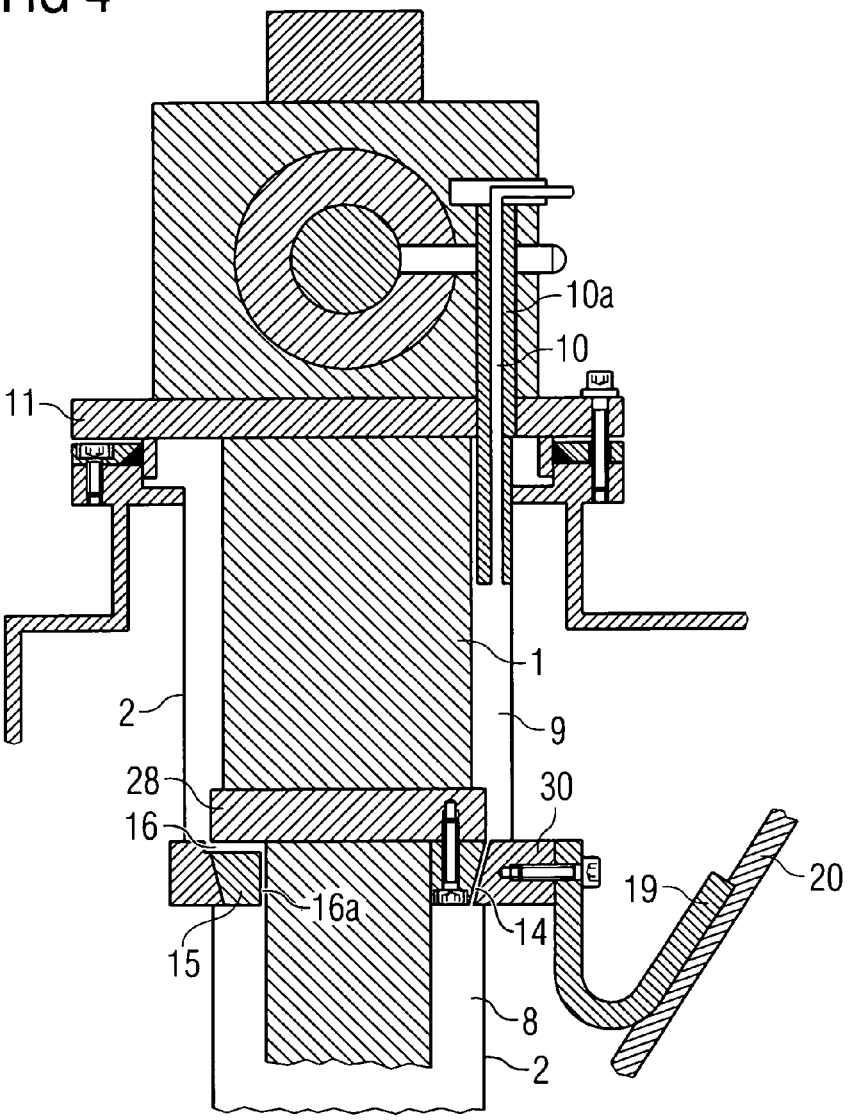
FIG. 4 shows a view corresponding to that of FIG. 3, according to another embodiment of the invention.

In an alternative embodiment, shown in FIG. 4, the lower extremity of connecting pipe 10 may extend into the upper part of the sock. This pipe may be thermally insulated 10*a*. Such an embodiment would have the advantage that the boil-off gas does not flow past the upper parts of the refrigerator, and the cooling effect on the more sensitive parts of the refrigerator may in this way be limited.

In tests, it has been found that the cryogen loss from a cryogenic magnet system adapted according to the present invention is reduced to approximately 50% of the loss form the same system which has not been modified according to the present invention.

While the present invention has been described with reference to a limited number of embodiments, given by way of examples only, the invention may be modified in numerous ways, which will be apparent to those skilled in the relevant art. For example, while the above example has described an MRI magnet system which is fitted with a very low temperature refrigerator for recondensation of cryogen gas so that in normal operation there would be no loss of cryogen, the present invention may be applied to more effectively remove the heat conducted by an inoperative refrigerator to thermal shield(s) used on a magnet system where only the shield(s) is/are refrigerated so as to reduce but not eliminate cryogen loss during normal operation.

The present invention may also be applied to the reduction of cryogen loss from any cryogenic vessel provided with a refrigerator which, when inoperative, provides a thermal load onto the cryogen vessel.

The invention claimed is:

1. A cryostat comprising a cryogenic vessel provided with an access neck and a refrigerator that is located in an interface sock which comprises a chamber extending, separate from and outside the access neck, from the exterior of the cryostat to be in thermal connection with the cryogenic vessel; wherein:

a passageway is provided from the interior of the cryogenic vessel, through the interface sock, to atmosphere, such that a portion of cryogen gas escaping from the cryogenic vessel flows through the passageway, thereby cooling the refrigerator, and another portion of cryogen gas escaping from the cryogenic vessel flows through the access neck to the atmosphere; and the cryostat further comprises an adjustable flow control device that regulates the flow of gas through the passageway, thereby to regulate the cooling of the refrigerator by escaping cryogen gas, and a thermal shield surrounding the cryogenic vessel, wherein the refrigerator makes thermal contact with the thermal shield through the interface sock, whereby cryogen gas escaping from the cryogen vessel flows through the passageway, thereby to cool the thermal shield, wherein the refrigerator is a two-stage refrigerator, the first stage of the refrigerator being thermally linked by a thermal connection to cool the thermal shield, the second stage of the refrigerator being arranged to directly cool the interior of the cryogenic vessel, and wherein a channel is provided to allow cryogen gas escaping from the cryogen vessel to flow along the passageway through or past the thermal connection.

2. A cryostat according to claim 1, wherein the passageway comprises:

an access to the cryogen vessel;

a cavity defined between a surface of the interface sock and the refrigerator; and an outlet tube leading from the interface sock towards the atmosphere.

3. A cryostat according to claim 2, wherein the passageway further comprises a pipe linking the outlet tube to the access neck.

4. A cryostat according to claim 1, further comprising a vacuum jacket surrounding the cryogenic vessel, wherein both the access neck and the interface sock each, separately traverse the vacuum jacket to make contact with both the cryogenic vessel and the ambient temperature.

5. A cryostat according to claim 1, wherein the passageway runs from the cryogenic vessel, through the interface sock to join an outlet of the access neck.

6. A cryostat according to claim 5, wherein an exhaust valve is provided just downstream from the joint between the passageway and the access neck.

7. A cryostat according to claim 1, wherein the thermal connection comprises a contact flange in thermal contact with the first stage of the refrigerator and a thermal contact itself in thermal contact with the shield, the contact flange and the thermal contact being in thermal and mechanical contact, by respective contact faces.

8. A cryostat according to claim 7, wherein the channel comprises a channel cut into the contact face of one of the contact flange and the thermal connection, the channel extending between upper and lower surfaces of the respective one of the contact flange and the thermal contact.

9. A cryostat according to claim 7, wherein the channel comprises a channel through the body of one of the contact flange and the thermal contact.

10. A cryostat according to claim 7, wherein the contact flange is approximately toroidal in shape, and the channel comprises a channel cut in an inner and an upper surface of the contact flange.

11. A cryostat according to claim 1, a valve is provided in the passageway for closing the passageway when required.

12. A cryostat according to claim 1, wherein the passageway comprises an outlet tube protruding into an upper portion of the interface sock, thereby to protect an adjacent portion of the refrigerator from excessive cooling by escaping cryogen gas.

13. A cryostat according to claim 1, wherein the cryostat further comprises a second passageway from the interior of the cryogenic vessel to atmosphere, such passageway being in thermal contact with the thermal shield, such that a portion of cryogen gas escaping from the cryogenic vessel flows through the second passageway, thereby to cool the thermal shield.

14. A cryostat according to claim 13, wherein the second passageway in thermal contact with the thermal shield comprises a pipe leading from the cryogenic vessel to a tube in close thermal contact with the shield, the second passageway exiting from the vacuum jacket through a further pipe, wherein the thermal conductivity of the tube is greater than the thermal conductivity of either pipe.

15. An MRI system comprising a superconductor magnet winding housed within the cryogenic vessel according to claim 1.

16. A cryostat comprising a cryogenic vessel provided with an access neck and a refrigerator that is located in an interface sock which comprises a chamber extending, separate from and outside the access neck, from the exterior of the cryostat to be in thermal connection with the cryogenic vessel, a thermal shield that surrounds the cryogenic vessel and a vacuum jacket that encloses the cryogenic vessel and the thermal shield in a vacuum; wherein:

a passageway is provided from the interior of the cryogenic vessel, through the interface sock, to atmosphere;

said passageway is in thermal contact with the thermal shield which surrounds the cryogenic vessel;

a portion of cryogen gas escaping from the cryogenic vessel flows through the passageway, thereby cooling the thermal shield; and another portion of cryogen gas escaping from the cryogenic vessel flows through an access neck of the cryogenic vessel, the refrigerator is a two-stage refrigerator, the first stage of the refrigerator being thermally linked by a thermal connection to cool the thermal shield, the second stage of the refrigerator being arranged to directly cool the interior of the cryogenic vessel, and wherein a channel is provided to allow cryogen gas escaping from the cryogen vessel to flow along the passageway through or past the thermal connection.

17. The cryostat according to claim 16, further comprising a means for regulating the flow of gas through the passageway, thereby to regulate the cooling of the thermal shield by escaping cryogen gas.

18. A cryostat according to claim 16, further comprising a second passageway from the interior of the cryogenic vessel to atmosphere, such passageway being in thermal contact with the thermal shield, such that a portion of cryogen gas escaping from the cryogenic vessel flows through the second passageway, thereby to cool the thermal shield.

19. A cryostat according to claim 18, wherein the second passageway in thermal contact with the thermal shield comprises a pipe leading from the cryogenic vessel to a tube in close thermal contact with the shield, the second passageway exiting from the vacuum jacket through a further pipe, wherein the thermal conductivity of the tube is greater than the thermal conductivity of either pipe.

* * * * *